United States Patent [19]

Alburas

[11] Patent Number: 4,920,601

[45] Date of Patent: May 1, 1990

[54] STRIP CURTAIN CLEANING DEVICE

[76] Inventor: Eric E. Alburas, 1441 N. McClellan St., Portland, Oreg. 97217

[21] Appl. No.: 248,643

[22] Filed: Sep. 26, 1988

[51] Int. Cl.[5] ..... A47L 13/16; A47L 13/46

[52] U.S. Cl. ..... 15/244.1; 15/210 R

[58] Field of Search ..... 15/210 R, 210 A, 209 R, 15/244.1, 244.2, 145, 143 R, 154, 147 R, 147 A, 147 B, 147 C, 147 D, 190, 150, 194, 220 R, 211, 229.5, 228, 176.1, 176.2, 176.3, 176.4, 176.5, 176.6, 230.11; D32/35, 40, 50, 51, 52

[56] References Cited

U.S. PATENT DOCUMENTS

| | | | |
|---|---|---|---|
| 336,746 | 2/1886 | Reisor | 15/154 X |
| 775,077 | 11/1904 | Dettmer | 15/220 R |
| 1,386,173 | 8/1921 | Hamilton | 15/147 R |
| 1,433,326 | 10/1922 | Wolfe | 15/244.1 |
| 2,550,734 | 5/1951 | Thompson | 15/147 R X |
| 2,789,307 | 4/1957 | Sussman et al. | 15/210 A X |
| 2,856,625 | 10/1958 | Delacretaz | 15/210 A X |
| 2,896,243 | 7/1959 | Schoenfield et al. | 15/244.2 |
| 3,130,435 | 4/1964 | Smith | 15/230.11 |
| 3,220,040 | 11/1965 | Knaebe | 15/147 R X |
| 4,000,537 | 1/1977 | Woo | 15/230.11 |
| 4,263,690 | 4/1981 | Dobosi | 15/230.11 X |
| 4,483,037 | 11/1984 | Jacobson | 15/210 A |
| 4,574,415 | 3/1986 | Vitonis | 15/210 A X |
| 4,718,141 | 1/1988 | Kuehnl | 15/394 |

FOREIGN PATENT DOCUMENTS

| | | | |
|---|---|---|---|
| 280932 | 4/1966 | Australia | 15/210 A |
| 166516 | 1/1950 | Austria | 15/244.1 |
| 1104743 | 11/1955 | France | 15/244.1 |
| 86281 | 8/1955 | Norway | 15/244.1 |

*Primary Examiner*—Harvey C. Hornsby
*Assistant Examiner*—Scott J. Haugland
*Attorney, Agent, or Firm*—James D. Givnan, Jr.

[57] ABSTRACT

A strip cleaning device having a shaped wire holder in which are removably held a pair of sponges or the like, in a parallel spaced apart relationship. A handle receives the wire holder. Parallel segments of the holder may flex apart from one another for sponge replacement purposes.

1 Claim, 1 Drawing Sheet

STRIP CURTAIN CLEANING DEVICE

BACKGROUND OF THE INVENTION

The present invention pertains generally to a hand held device for cleaning both sides of pliable strips of the type used in stores to provide a thermal barrier.

In wide use in grocery stores are curtains formed from clear plastic strips which permit the customer to view the goods and which allow removal of the goods from a cooled or refrigerated cabinet. Such curtains are widely used in various establishments to confine cooled air within a food or beverage storage area.

As the strips must be periodically cleaned, it has heretofore been necessary for a store employee to manually draw a saturated sponge or cloth over both sides of the strip while holding same taut with the remaining hand. Accordingly, such a cleaning effort is both time-consuming and often results in less than complete cleaning of the strip. As a large grocery store or supermarket will utilize several such curtains, the time spent in cleaning same can amount to several man-hours per month.

U. S. Pat. No. 4,718,141 is of interest in that it shows a tool for vacuuming Venetian blinds.

SUMMARY OF THE PRESENT INVENTION

The present invention is embodied within a cleaning device having a pair of strip wiping members disposed adjacent one another to act on both sides of a pliable strip as the user draws the device along the length of the strip.

The strip wiping members are carried by the cleaning device in a parallel, spaced apart manner with the strip being cleaned passing therebetween along a curved path. As such curtain strips hang freely, the present device may be inclined to achieve positive frictional engagement of both absorbent members with opposite sides of the strip for thorough cleaning purposes. Provision is made for replacement of the absorbent members in an expeditious manner without the use of tools.

Important objectives include the provision of a hand held cleaning device having a pair of absorbent members simultaneously engageable with opposite sides of a pliable strip to effect cleaning of same; the provision of a cleaning device wherein parallel absorbent members are removably attached to a handle of the device to permit convenient removal and replacement of the members; the provision of a cleaning device lending itself to low cost manufacturing techniques and is convenient to use.

DETAILED DESCRIPTION OF THE PREFERRED EMBODIMENTS

Figure 1:
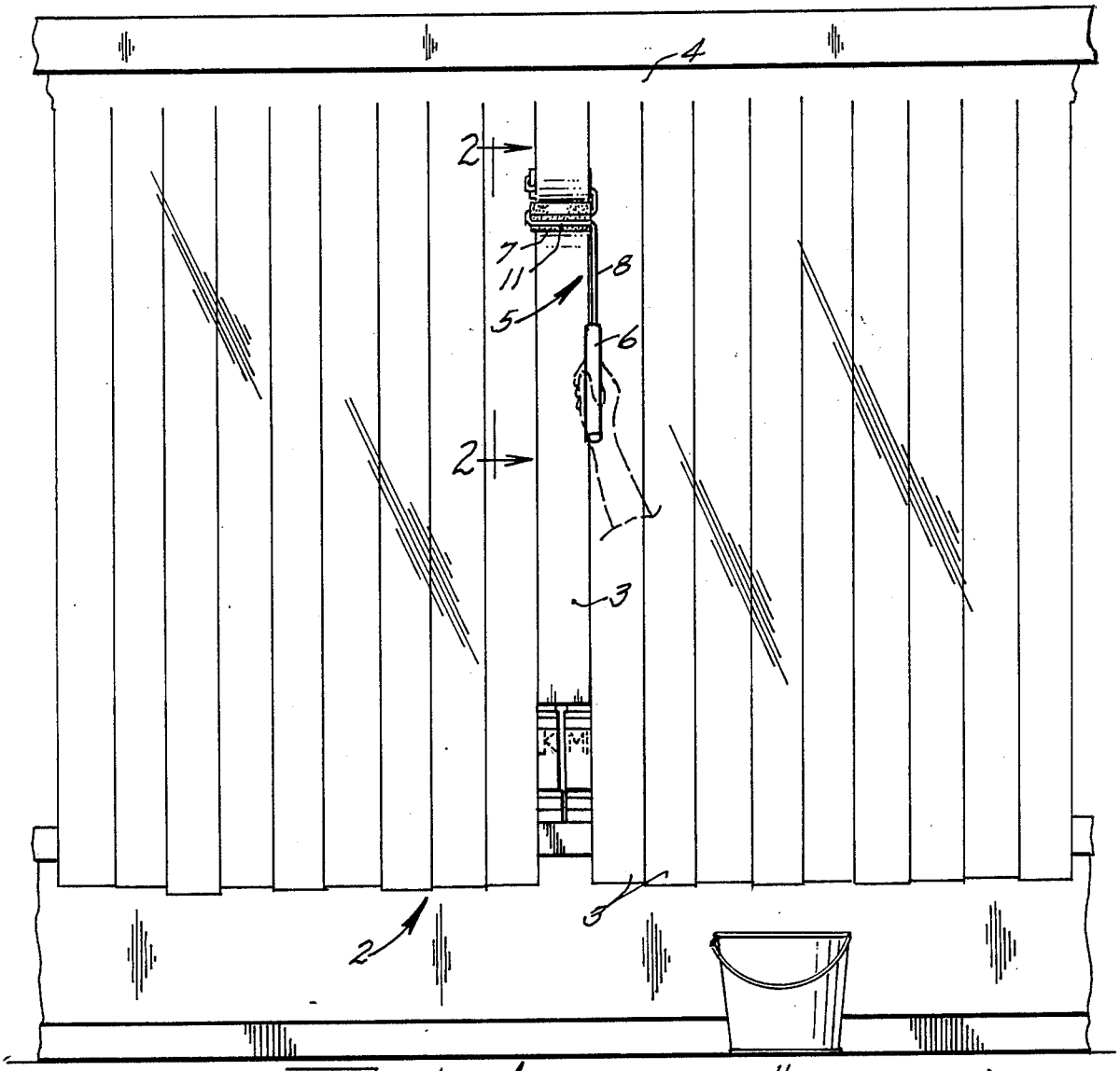
FIG. 1 is a front elevational view of a typical refrigerated food storage cabinet provided with a strip curtain or barrier with the present device in use on one of the curtain strips.

With continuing attention to the drawings wherein applied reference numerals indicate parts similarly hereinafter identified, the reference numeral 1 indicates a food storage cabinet of the type found in grocery stores or supermarkets served by a refrigeration system to maintain cabinet contents below room temperature.

A curtain generally at 2 is slit at intervals to comprise strips 3 which are of a clear pliable nature and serve to confine cooled air within the cabinet while permitting access to the food articles. Such curtains have a continuous upper margin at 4 for convenient securement to the overhead portion of the cabinet. The strips hang generally vertical with their lower end free allowing strip displacement such as during removal of a food article.

Indicated generally at 5 is the present cleaning device shown in use in FIG. 1 wherein an elongate handle 6 is grasped by one of the users hands.

Figure 2:
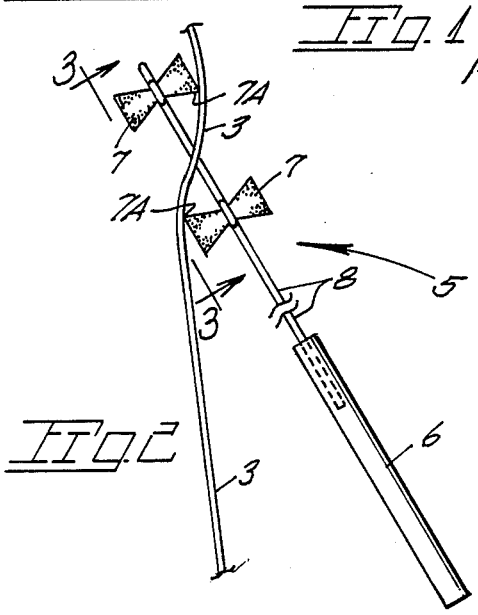
FIG. 2 is a side elevational view taken along line 2-2 of FIG. 1.
Figure 3:
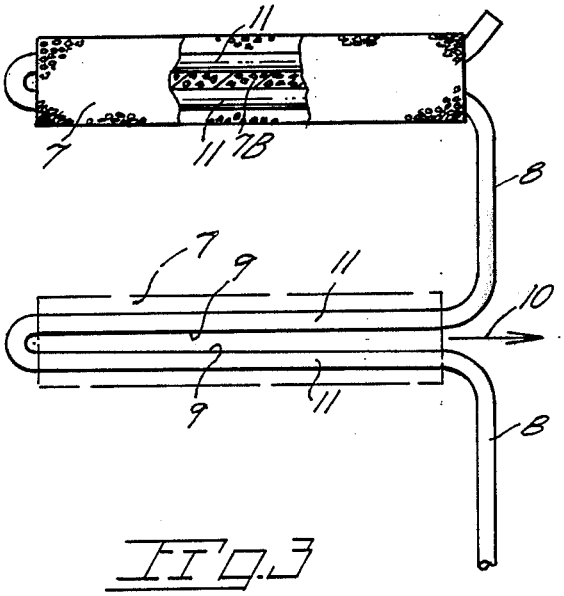
FIG. 3 is an elevational view taken along line 3-3 of FIG. 2 with the strip removed.

Absorbent members at 7 are disposed in perpendicular fashion to a projected axis of handle 6 with each member being of a length adequate to fully wipe the width of the strip surfaces. The absorbent members 7 are closely spaced as viewed in FIG. 2 so as to require curved passage of the strip therebetween when the present device is held in an upright manner. As the strips tend to hang vertically, the distortion of same as shown in FIG. 2 results in edges of 7A of each cleaning member to come into biased engagement with the surfaces to assure a desired cleaning action.

Mounting means at 8 serve to dispose the absorbent members in the closely spaced apart manner as above noted. Preferred mounting means is embodied within a bent wire structure providing bite surfaces 9 on parallel segments 11 within pairs of which are pinched portions 7B of absorbent members 7. The bent wire structure permits frictional engagement with the absorbent members which may be sponges to hold same in place during use of the cleaning device yet permits the user to slidably remove the absorbent members per arrow 10 and substitute new members all without use of a hand tool.

The wire segments 11 may be momentarily sprung apart to release sponges 7 or other absorbent members and permits convenient insertion of replacement members.

While the present device is particularly useful for the cleaning of curtain strips, it will be understood that it may be otherwise utilized for the cleaning of various other items. Further, the device may be used on strips of a greater width than those shown by simply rotating the handle 180 degrees and re-engaging the absorbent members with the opposite sides or surfaces of the strip.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A cleaning device for cleaning pliable strips of a curtain, said device comprising, an elongate handle, absorbent members in spaced apart parallel relationship and generally perpendicular to the projected major axis of the handle, said members adapted to simultaneously wipe the opposite surfaces of said strips, and a bent wire having an end segment in said handle, said wire having pairs of parallel wire segments with the segments of each pair at all times spaced from one another a distance less than the normal thickness of each of said absorbent members, each of said pairs in frictional engagement with one of said absorbent members.

* * * * *